United States Patent [19]

Rottmann et al.

[11] Patent Number: 4,824,453

[45] Date of Patent: Apr. 25, 1989

[54] PROCESS AND APPARATUS FOR AIR SEPARATION BY RECTIFICATION

[75] Inventors: Dietrich Rottmann, Munich; Horst Corduan, Puchheim, both of Fed. Rep. of Germany

[73] Assignee: Linde Aktiengesellschaft, Wiesbaden, Fed. Rep. of Germany

[21] Appl. No.: 217,516

[22] Filed: Jul. 11, 1988

[30] Foreign Application Priority Data

Jul. 9, 1987 [DE] Fed. Rep. of Germany ..... 3722746

[51] Int. Cl.[4] ..... F25J 3/04

[52] U.S. Cl. ..... 62/22; 62/24; 62/33

[58] Field of Search ..... 62/9, 11, 22, 23, 24, 62/32, 33, 42

[56] References Cited

U.S. PATENT DOCUMENTS

| | | | |
|---|---|---|---|
| 2,280,383 | 4/1942 | De Boufre | 62/22 X |
| 3,688,513 | 9/1972 | Streich et al. | 62/22 |
| 4,137,056 | 1/1979 | Golouko | 62/24 X |
| 4,433,989 | 2/1984 | Erickson | 62/42 X |
| 4,578,095 | 3/1986 | Erickson | 62/22 |
| 4,604,116 | 8/1986 | Erickson | 62/22 X |

*Primary Examiner*—Steven E. Warner

*Attorney, Agent, or Firm*—Millen & White

[57] ABSTRACT

In a process and apparatus for air separation by rectification air 1 is preliminarily separated in a first rectification stage 2 of a two-stage rectification column to obtain a nitrogen-rich fraction 4 and an oxygen-rich fraction 8. These two fractions are fed to the second rectification stage 6 and separated into oxygen and nitrogen fractions. An argon-enriched fraction, containing essentially oxygen and argon, is removed from the second rectification stage at an intermediate point and is separated in a raw argon column 10 by rectification into an argon-rich fraction 18 and a liquid fraction 19 containing essentially oxygen. The liquid fraction 19 is fed back into the second rectification stage. Another fraction 22 is removed from the raw argon column above the bottom thereof and is separated in a high-purity oxygen column 23 to produce a high-purity oxygen fraction 25, 26 and a lighter residual fraction 24. An additional nitrogen-rich fraction is removed from the head of the first rectification stage and separated in a high-purity nitrogen column 31 producing a bottom liquid fraction 29, which is fed back to the head of the first rectification stage, and a residual gas fraction 33. A high-purity nitrogen fraction 34 is removed at a point several plates below the head of the first rectification stage.

35 Claims, 4 Drawing Sheets

PROCESS AND APPARATUS FOR AIR SEPARATION BY RECTIFICATION

BACKGROUND OF THE INVENTION

The invention relates to a process for air separation by rectification, in which in a first rectification stage air is preliminarily separated into a nitrogen-rich and an oxygen-rich fraction. The two fractions are fed to a second rectification stage and separated into oxygen and nitrogen. A stream containing essentially oxygen and argon is removed from the second rectification stage at an intermediate point and by rectification in a raw argon column is separated into an argon-rich fraction and a liquid fraction containing essentially oxygen. The fraction containing essentially oxygen is fed back into the second rectification stage. The invention further relates to an apparatus for carrying out such a process.

Such a process, in which, besides oxygen and nitrogen, a raw argon fraction is also recovered, is described in U.S. Pat. No. 4,575,388. Argon, whose boiling point is between the boiling points of nitrogen and oxygen, is present at an increased concentration at an intermediate point of the second rectification stage. At this point, a fraction is removed which is enriched with argon and contains mainly oxygen as well as certain portions of nitrogen. By rectification, the argon-enriched fraction is separated in the raw argon column into a raw argon fraction, which is polluted by residual oxygen and nitrogen, and a liquid bottom fraction consisting essentially of oxygen. The bottom fraction is fed back into the second rectification stage.

Besides raw argon, oxygen is recovered as another product in this process. Oxygen is removed at the lower end of the second rectification stage.

The oxygen-rich liquid, which accumulates in the bottom of the raw argon column, exhibits a relatively high concentration of impurities. The enriched argon fraction from the second rectification stage, besides oxygen and nitrogen, also contains the impurities krypton, xenon and hydrocarbons, all of which accumulate in the bottom of the raw argon column. The impurities reach the bottom of the second rectification stage by the delivery of bottom liquid from the argon column into the second rectification stage and thus into the oxygen removed as a separation product.

Because of the impurities in the oxygen, the process does not permit the recovery of high-purity product streams—free of krypton, xenon and hydrocarbons—from the second rectification stage, especially product liquid oxygen. High-purity oxygen is necessary, for example, as breathable oxygen and also in the electronic industry.

In addition, the product nitrogen recovered in the known process contains traces of other gases, for example, helium, neon, hydrogen and carbon monoxide. Such nitrogen is insufficient for the modern semiconductor industry where nitrogen of the highest purity is required.

Carbon monoxide can be removed catalytically. Some helium, neon and hydrogen can be removed by a helium outlet, usually placed at the head of the first rectification stage; however, the helium outlet results in only a slight reduction of these impurities.

SUMMARY OF THE INVENTION

An object of the invention is to provide a process and an apparatus of the initially mentioned type, which makes possible the production of high-purity oxygen, essentially free of krypton, xenon and hydrocarbons.

A further object of the invention is to provide a process and an apparatus of the type mentioned which makes possible the production of high-purity nitrogen.

Another object of th invention is to provide a process and apparatus of the type mentioned for simultaneously producing high-purity oxygen and high-purity nitrogen.

A further object is to provide high-purity oxygen and/or high-purity nitrogen in liquid form, gaseous form or both.

Upon further study of the specification and appended claims, further objects and advantages of this invention will become apparent to those skilled in the art.

The production of high-purity oxygen is achieved by removing a side fraction from the raw argon column at a point above the bottom and separating this fraction in a high-purity oxygen column to produce a high-purity oxygen fraction and a lighter residual fraction.

The concentration of krypton, xenon and hydrocarbons decreases upwardly from the argon column bottom. The side fraction removed above the argon column bottom therefore contains only the components oxygen, argon and nitrogen, while it is essentially free of krypton, xenon and hydrocarbons. In the high-purity oxygen column, the oxygen is separated from nitrogen and argon by rectification. In this way, oxygen of improved purity can be produced, for example a high purity of about 99.999%. The high-purity oxygen contains, for example, less than about 10 ppm (parts per million) in each case, preferably less than about 5 ppm, most preferably less than about 2 ppm of hydrocarbons, krypton, xenon and nitrogen as well as less than about 20 ppm, preferably less than about 15 ppm of argon.

The term "high-purity" oxygen means an oxygen fraction having a purity of more than 99.998%, especially more than 99.999%. The term "essentially free of impurities" means less than about 60 ppm, preferably less than about 20 ppm, especially not more than 10 ppm impurities; contents of individual substances are preferably:

| | |
|---|---|
| hydrocarbons | less than 1 ppm |
| Kr | less than 1 ppm |
| Xe | less than 1 ppm |
| $N_2$ | less than 5 ppm |
| Ar | less than 10 ppm |

In a preferred further development of the process according to the invention, the fraction removed from above the bottom of the argon column is removed in liquid form and delivered to the high-purity oxygen column as reflux liquid.

According to a preferred further development of the process according to the invention, removal of this fraction occurs several plates above the bottom of the raw argon column.

The plates between the argon column bottom and the removal point act as baffles for the undesired portions of krypton, xenon and hydrocarbons. Preferably, 3 to 5 rectification plates are provided as baffles. The removal point of the fraction from the argon column is preferably at distance from the bottom of about 1/20 the total length of the column. For example, in a 56-plate column, the removal point is 3 plates from the bottom.

In a preferred further development of the process according to the invention, the lighter residual fraction removed from the high-purity oxygen column is fed back into the argon column or into the second rectification stage.

The residual fraction, which contains essentially oxygen, nitrogen and argon, is removed from the head of the high-purity oxygen rectification column and preferably fed back into the argon column above the removal point of the side fraction or is fed back into the second rectification stage, e.g. at about the removal point of the argon-enriched fraction.

The argon-enriched fraction is removed, for example, at a distance of 20 plates from the head of the second rectification stage, which contains a total of 55 plates. The residual fraction is fed back to the second rectification stage at a point, for example, 2 plates above the removal point of the argon-enriched fraction.

In another preferred configuration of the process according to the invention, the bottom of the high-purity oxygen column is heated by nitrogen from the head of the first rectification stage. Heating preferably takes place by heat exchange in a condenser-evaporator placed in the bottom of the high-purity oxygen column. In this connection, it is advantageous if the nitrogen used during heating is at least partially condensed and the condensate is fed back into the first rectification stage.

The oxygen recovered in the bottom of the high-purity oxygen column is preferably removed in liquid form. If high-purity gaseous oxygen is to be produced with the process, at least a part of the high-purity oxygen is removed in gaseous form from the high-purity oxygen column according to a preferred further development of the process of the invention. Removal of a high-purity gaseous oxygen fraction in this case takes place just above the liquid level in the column bottom.

In a preferred further development of the process according to the invention, the high-purity oxygen is removed several plates above the bottom of the high-purity oxygen column, e.g., 3 to 5 plates above the bottom.

For example, in a high-purity oxygen column containing 50 actual plates, the high-purity oxygen fraction is removed 3 plates above the bottom of the column, 6.5% of the total length of the column.

The only fraction, which is fed into the high-purity oxygen column, i.e., the side fraction removed from the argon column, generally only contains impurities at an order of magnitude far below ppm. Still, higher levels of impurities can occur in the bottom of the high-purity oxygen column due to enrichment of the very small traces or by penetration from outside, for example, through unsealed points in the bottom heating neons. Therefore, removal of a high-purity oxygen fraction several, preferably three to five, plates above the bottom of the high-purity oxygen column is especially favorable. These plates—as in the raw argon column—serve at baffles for the undesired traces of krypton, xenon and hydrocarbons.

The high-purity oxygen can be removed at this point in liquid as well as in gaseous form. To avoid a slow enrichment of impurities in the bottom during operation, it is advantageous, if a small part of the bottom fluid is removed from the high-purity oxygen column and discarded or fed back into the second rectification stage.

The amount of bottom fluid discarded or fed back to the second rectification is about 1% of the amount of gas entering the high-purity oxygen column as side fraction.

It proves advantageous, if, according to a further development of the process according to the invention, liquid oxygen is removed from the bottom of the second rectification stage and subcooled by heat exchange with nitrogen from the second rectification stage.

In a further development of the invention, production of high-purity nitrogen is achieved by removing another nitrogen-rich fraction from the head of the first rectification stage, in addition to the nitrogen-rich fraction delivered to the second rectification stage, and delivering the additional nitrogen-rich fraction to a high-purity nitrogen column wherein it is separated into a bottom liquid fraction and a residual gas fraction.

By these process steps, nitrogen can be produced as a high-purity separation product. For this purpose, helium, neon, hydrogen and carbon monoxide are separated by rectification in the high-purity nitrogen column and removed in the residual gas fraction. The residual gas fraction, for example, can be mixed with impure nitrogen, which usually is removed from the second rectification stage and is used for regeneration of molecular sieve adsorbers.

The bottom liquid of the high-purity nitrogen column is preferably fed back to hhe head of the first rectification stage.

In this manner, the nitrogen purity in the head of the first rectification stage is increased and, in addition, a high-purity nitrogen fraction can be recovered. The high-purity nitrogen fraction preferably is removed in liquid form from the head of the first rectification stage.

In this case it proves particularly advantageous, if in a further configuration of the invention a liquid high-purity nitrogen fraction is removed at a point several plates below the head of the first rectification stage.

About 2 to 5 plates separate the removal point of the high-purity liquid nitrogen fraction from the head of the first rectification stage. Thus, for example, in a first rectification stage containing 70 actual plates, the high-purity liquid nitrogen fraction is removed 3 plates below the head thereof e.g. 4% of the total length of the column.

Residues of light gases such as helium, neon or hydrogen—which, despite a helium discharge and even with the use of the additional rectification in the high-purity nitrogen column, can be enriched at the head of the first rectification stage—are held back by the intermediate plates between the head condenser and the high-purity nitrogen fraction removal point. The liquid high-purity nitrogen exhibits a purity, e.g., of 99.999%. Argon, helium, neon, hydrogen and carbon monoxide may be present as impurities.

It proves especially advantageous in this case if, in a further configuration, a part of a high-purity nitrogen liquid fraction removed from the head of the first rectification stage is subcooled, throttle-expanded and the gaseous portion thus evaporated is added to a nitrogen fraction removed from the second rectification stage.

The term "high-purity" nitrogen means a nitrogen fraction having a purity of more than 99.998%, especially more than 99.999%. The high-purity nitrogen fraction contains less than about 20 ppm, preferably not more than 10 ppm impurities; contents of individual substances are preferably:

| | |
|---|---|
| CO | less than 1 ppm |
| He | less than 1 ppm |
| Ne | less than 1 ppm |
| Hg | less than 1 ppm |
| Ar | less than 5 ppm |

In a favorable further development of the process according to the invention, the liquid high-purity nitrogen is subcooled at least partially. As a result, storage of the liquid product portion in a tank is made easier. Cooling preferably is performed in indirect heat exchange with nitrogen from the second rectification stage. The high-purity nitrogen can then be fed to a separator and removed from it as liquid.

If a part of the high-purity nitrogen is to be recovered as gas, it proves favorable if the liquid high-purity nitrogen is evaporated at least partially in heat exchange with the condensing nitrogen from the head of the first rectification stage.

According to a preferred further development of the invention, the bottom liquid of the high-purity oxygen column is heated by heat exchange with the gas in the head of the high-purity nitrogen column. In this way, both oxygen and nitrogen can be produced as separation products of the highest purity. The energy expenditure is especially small by the heat exchange between high-purity oxygen column and high-purity nitrogen column.

By this measure, the nitrogen purity in the head of the first rectification stage is increased and, in addition, nitrogen with a high purity can be recovered. The high-purity nitrogen preferably is removed in liquid form from the head of the first rectification stage.

Heat exchange between the bottom of the high-purity oxygen column and the high-purity nitrogen column is provided by a common condenser-evaporator. In this way, the high-purity oxygen column and high-purity nitrogen column can be produced as a unit, which results in further savings of production and capital costs.

An apparatus for carrying out the production of high-purity oxygen according to the invention comprises: a two-stage rectification column having a feed means for introducing air to be separated and removal pipes for nitrogen, oxygen and a fraction enriched with argon; an argon column which is connected to the second stage by the removal pipe for the fraction enriched with argon and by a return pipe for the argon column bottom liquid; and a high-purity oxygen column connected to the argon column by a lateral removal pipe.

In a further development of the apparatus according to the invention, the position of the lateral removal pipe is separated by several rectification plates from the bottom of the argon column.

In a further development of the apparatus aspect of the invention, the head of the high-purity oxygen column is connected either to the argon column above the removal point of the side fraction or is connected to the second rectification stage. The entry point of the residual fraction from the head of the high-purity oxygen column into the second rectification stage and the removal point for the argon-enriched fraction need not be separated by any plates.

An apparatus for the recovery of the high-purity nitrogen comprises: a two-stage rectification column and a high-purity nitrogen column. The high-purity nitrogen column is connected to the first rectification stage by a gas pipe and by a liquid pipe. The first rectification stage is further provided with a removal pipe for removing high-purity nitrogen, at a point several plates below the head of the first rectification stage.

An apparatus for the production of both high-purity oxygen and high-purity nitrogen comprises: a two-stage rectification column; an argon column which receives an argon-enriched fraction from the second rectification stage; a high-purity oxygen column which receives a side fraction from the argon column; and a high-purity nitrogen column in heat exchange with the bottom of the high-purity oxygen column by a common condenser-evaporator and receiving a nitrogen-rich fraction from the head of the first rectification stage.

With respect to operating pressures the units are, for example, operated at the following pressure:

| | |
|---|---|
| first rectification stage | 6.0 bar (head), |
| | 6.2 bar (bottom); |
| second rectification stage | 1.3 bar (head), |
| | 1.55 bar (bottom); |
| raw argon column | 1.21 bar (head), |
| | 1.4 bar (bottom); |
| high-purity oxygen column | 1.4 bar (head), |
| | 1.55 bar (bottom); and |
| high-purity nitrogen column | 5.99 bar (head), |
| | 6.00 bar (bottom). |

BRIEF DESCRIPTION OF THE DRAWINGS

Various other objects, features and attendant advantages of the present invention will be more fully appreciated as the same becomes better understood when considered in connection with the accompanying drawings, in which like reference characters designate the same or similar parts throughout the several views, and wherein.

DETAILED DESCRIPTION OF THE DRAWINGS

Figure 1:
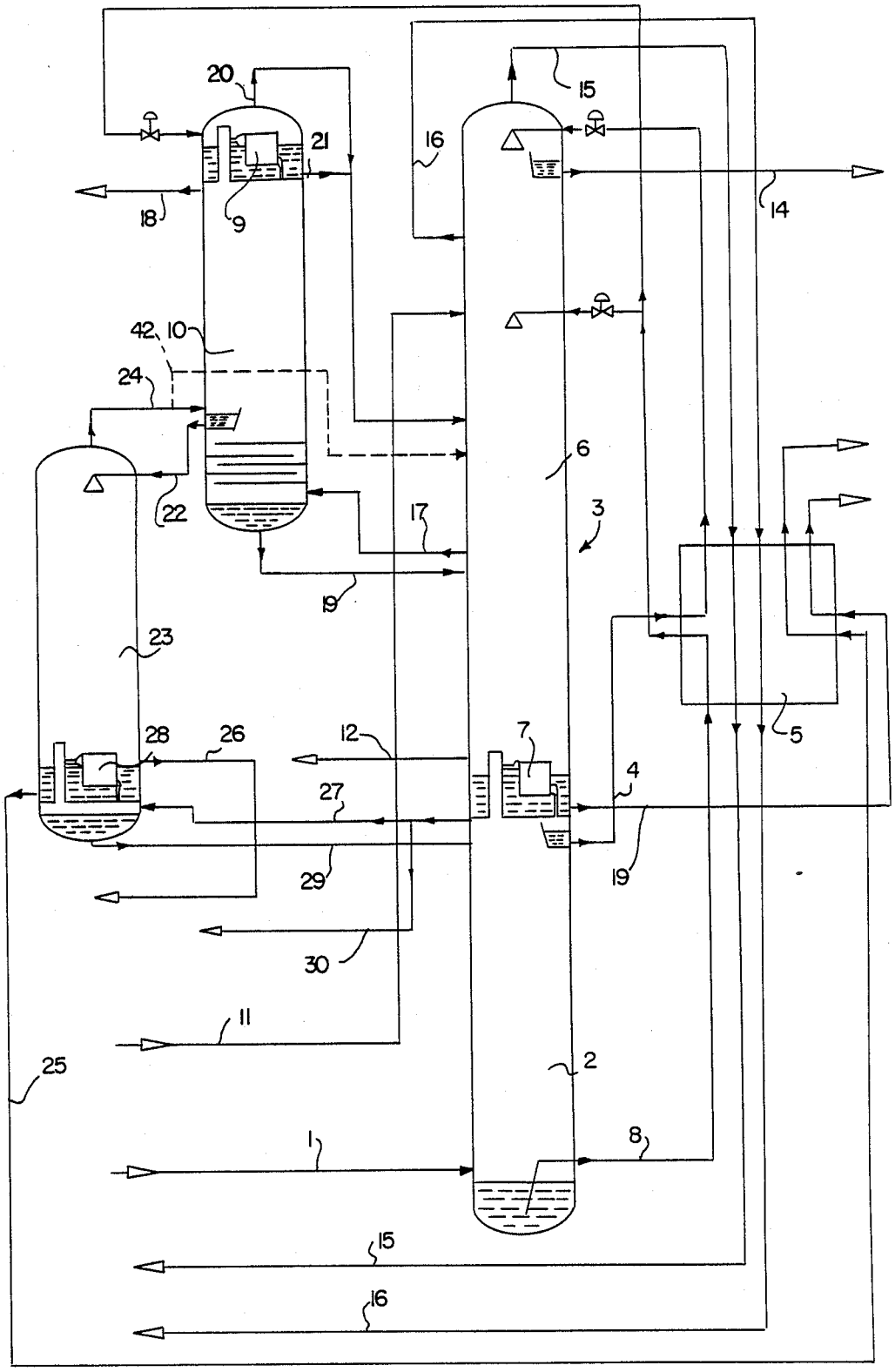
FIG. 1 illustrates an embodiment of the process and apparatus according to the invention for production of high-purity oxygen.

Air, previously purified of impurities such as $CO_2$ and $H_2O$ in the usual way and compressed to a pressure of about 6.3 bar, is fed by a pipe 1 to first stage 2 of a two-stage rectification column 3. The air is preliminarily separated into a nitrogen-rich fraction in the head and an oxygen-rich fraction in the bottom at a temperature of about −177° C. A part of the nitrogen-rich fraction is removed in liquid form via pipe 4, subcooled in a heat exchanger 5, expanded and delivered with a temperature of about −193° C. as reflux to second stage 6 of rectification column 3. The two stages 2, 6 of the rectification column 3 are in heat exchange connection with one another by a common condenser-evaporator 7. The first stage 2 contains 68 actual rectification plates and the second stage 6 contains 55 actual plates.

The oxygen-rich fraction is removed from the bottom of first stage 2 by a pipe 8, subcooled in heat exchanger 5 and removed from it at an intermediate point, which is at a higher temperature level than that of the introduction point of the nitrogen-rich fraction 4. A part of the oxygen-rich fraction, which is at a temperature of about −182° C., is delivered at an intermediate point to second stage 6, while the remainder is fed as coolant to a condenser-evaporator 9 in the head of a raw argon column 10.

Another previously purified air stream, which for cold production was compressed and then expanded, is fed by a pipe 11 to second stage 6 about at the level of the feed of oxygen-rich fraction 8. In second stage 6, which is operated at a temperature of about −179° C. and a pressure of about 1.6 bar, the preliminarily separated fractions from the first stage are separated into pure oxygen, which is recovered in the column bottom, and into pure nitrogen, which is recovered in the column head. Typically, the oxygen has a purity of 99.5% of $O_2$ and 0.5% of argon. In addition, it contains all the krypton, xenon and hydrocarbons in the ppm range, which are present in the air.

The oxygen is removed in gaseous form above the column bottom by a pipe 12 and/or in liquid form from the column bottom by a pipe 13. The liquid oxygen is subcooled in heat exchanger 5.

Liquid nitrogen with a purity of 99.995% is removed from the head of second stage 6 via pipe 14. Gaseous pure nitrogen with a purity of 99.995% is removed from the head of second stage 6 by a pipe 15. These two nitrogen fractions are still contaminated by the usual components such as oxygen, argon, helium, neon, hydrogen and carbon monoxide.

Impure gaseous nitrogen (having about 0.15% $O_2$ content) is removed from the upper third of the column by pipe 16. The two gaseous nitrogen streams are heated in heat exchanger 5 and removed from the installation.

A little below the column middle, approximately between the 35th and 36th plates in a total plate number of 96, argon concentration is at its highest in second stage 6. At this level, a fraction is removed from the second stage 6 by a pipe 17 containing 91% of $O_2$, a few ppm of $N_2$, up to 9% of argon as well as traces of xenon, krypton, and hydrocarbons in the ppm range. This fraction is fed to a point at the lower end of the argon column 10 and is separated therein by rectification into a gaseous raw argon fraction, which is removed from the head of the argon column by a pipe 18, and a liquid bottom fraction, which is fed back into the second stage 6 by a pipe 19. The argon fraction preferably exhibits a composition of 2% of $O_2$, 97% of argon and 1% of $N_2$; the bottom liquid exhibits a composition of 94% of $O_2$, 6% of argon. The argon column contains 55 actual plates.

A part of the raw argon is condensed with formation of reflux liquid in condenser-evaporator 9 by heat exchange with an expanded portion of the oxygen-rich fraction 8 removed from the first stage 2. In the heat exchange, the oxygen-rich liquid is partially evaporated. The evaporated portion is removed by a pipe 20 and fed into second stage 6 with liquid removed from the evaporator space via pipe 21. A side liquid fraction is removed from the raw argon column at a point 3 to 5 plates above the bottom liquid by a pipe 22 and delivered to a high-purity oxygen column 23. Fraction 22 contains essentially the components $O_2$, argon and $N_2$ and is free of krypton, xenon and hydrocarbons. The reason for this is that the impurities (krypton, xenon and hydrocarbons) are held by the plates between the argon column bottom and the side fraction removal point in the argon column and are channeled back into second stage 6 by pipe 19. The high-purity oxygen column 23 contains 50 actual plates.

In the high-purity oxygen column 23, which is operated at a temperature of −179° C. and a pressure of 1.5 bar, nitrogen and argon are separated from the oxygen and removed from the head as a gaseous residual fraction by a pipe 24 and fed back, above the removal point of liquid fraction 22, into the raw argon column or into second stage 6 above the removal point of pipe 17 (dashed pipe 42). A high-purity liquid oxygen with a purity of 99.999% is removed from the bottom of the high-purity oxygen column 23 by a pipe 25. The oxygen typically exhibits the following impurities: hydrocarbons, krypton, xenon, nitrogen each less than 1 ppm, and argon less than 10 ppm. The high-purity liquid oxygen is subcooled in heat exchanger 5 and then removed from the installation. If required, additionally or alternatively high-purity gaseous oxygen can be removed from above the column bottom by pipe 26.

Heating of the column bottom takes place by nitrogen, which is removed from the head of first stage 2 and fed by pipe 27 into condenser-evaporator 28 placed in the column bottom. In the heat exchange, the nitrogen condenses and is fed back by a pipe 29 again into the head of first stage 2. A part of the gaseous nitrogen is diverted from pipe 27 and removed by a pipe 30.

Figure 2:
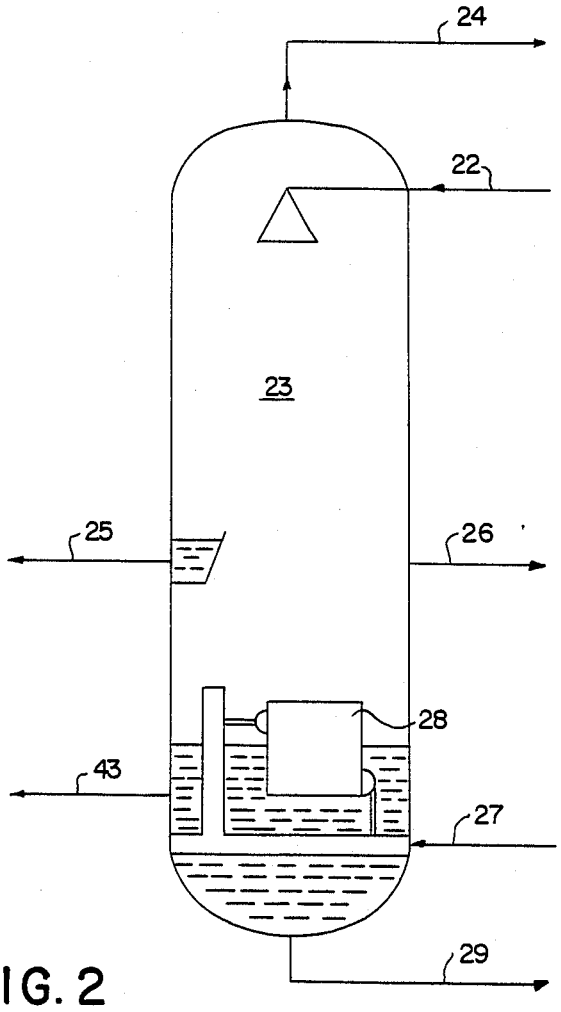
FIG. 2 illustrates another embodiment for production of high-purity oxygen.

FIG. 2 shows a variation of the process of FIG. 1. Since most of the modified process is identical with that of FIG. 1, only the high-purity oxygen column 23 is represented in FIG. 2.

Removal of the liquid high-purity oxygen by pipe 25, or of gaseous high-purity oxygen by pipe 26 takes place several plates above the bottom. The preferably three to five rectification plates hold back the undesirable portions such as krypton, xenon and hydrocarbons, which by enrichment of traces or by penetration through less sealed points on condenser-evaporator 28 can get into the bottom of high-purity oxygen column 23.

Pipe 43 serves for removal of a small amount of the bottom fluid which is either discarded or fed back into the second rectification stage. In this way, enrichment of undesirable portions in the bottom of the high-purity oxygen column 23 can be largely avoided.

Figure 3:
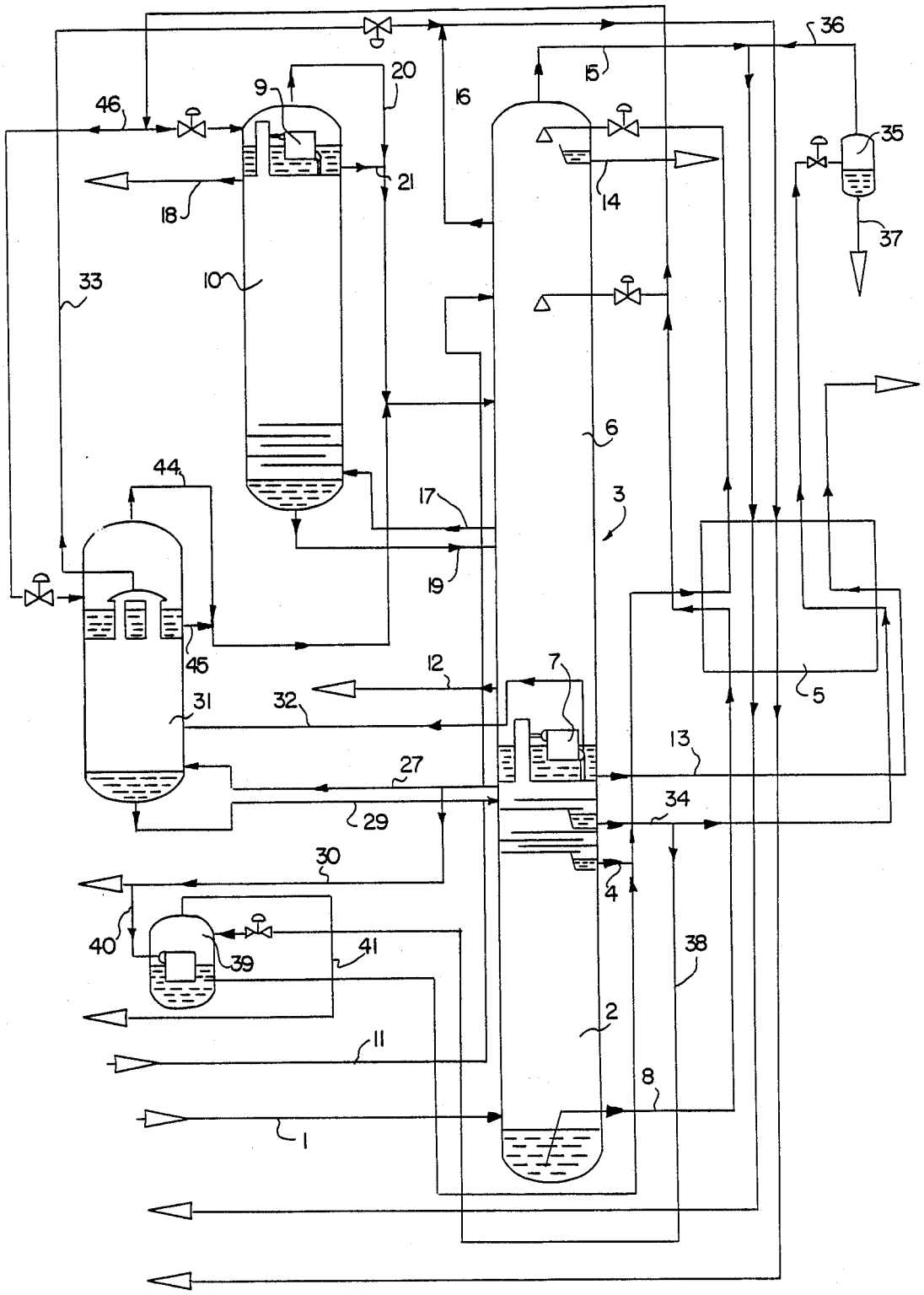
FIG. 3 illustrates an embodiment of the process and apparatus according to the invention for the production of high-purity nitrogen.

FIG. 3 shows another embodiment of the process according to the invention, in which high-purity nitrogen is produced.

Gaseous nitrogen is fed from the head of first rectification stage 2 by pipe 27 into a high-purity nitrogen column 31, which is operated approximately at the same pressure as the first rectification stage 2, and separated there into a liquid bottom fraction and a residual gas fraction. The residual gas fraction contains undesirable portions of impurities such as helium, neon and carbon monoxide and is removed by pipe 33 and mixed with impure nitrogen fraction 16 from second rectification stage 6. The high-purity nitrogen column contains 5 actual rectification plates.

The bottom fraction flows by pipe 29 back to the first rectification stage 2, from which high-purity nitrogen is removed by pipe 34. Between the head condenser and removal point for pipe 34 are two to five rectification plates, which act as baffles for helium, neon and carbon monoxide, whose concentration is greatest in the head of the column. High-purity nitrogen 34 exhibits a purity of 99.999%, the remainder consists basically of argon.

Besides pipe 27, another pipe 32 delivers fluid to high-purity nitrogen column 31. Pipe 32 is connected directly to condenser 7 and is identified as a helium discharge. The air components helium, neon and carbon monoxide are enriched in this area. These components, together with nitrogen, are removed by pipe 32 from first stage 2 and, with the head fraction 33, are removed from high-purity nitrogen column 31.

The head of high-purity nitrogen column 31 is cooled with oxygen-rich liquid 46, delivered from the bottom of first rectification stage 2. The oxygen-rich liquid in this case is partially evaporated, discharged from the head condenser of high-purity nitrogen column 31 by pipe 44 and/or 45 and is introduced into second rectification stage 6.

After the impurities (Ne, He, Co) have been removed in pipe 33, high-purity liquid nitrogen is recovered from the head of first stage 2. The nitrogen exhibits a composition of 99.999% of $N_2$ and 10 ppm of Ar.

If the high-purity nitrogen is desired in liquid form, the nitrogen is removed via pipe 34, subcooled in heat exchanger 5 and expanded. The flash gas resulting from the expansion is separated in a separator 35 and added by pipe 36 to the nitrogen in pipe 15. High-purity nitrogen in liquid form is removed from separator 35 by pipe 37.

If in addition or alternatively high-purity gaseous nitrogen is necessary, a high-purity liquid nitrogen is partially or totally expanded, without previous subcooling, and fed to an evaporator 39 via pipe 38. The evaporator is heated by a partial stream of the gaseous nitrogen in pipe 30, which is diverted by pipe 40 and then added to the nitrogen-rich fraction 4. The high-purity gaseous nitrogen is removed by a pipe 41 from evaporator 39.

Figure 4:
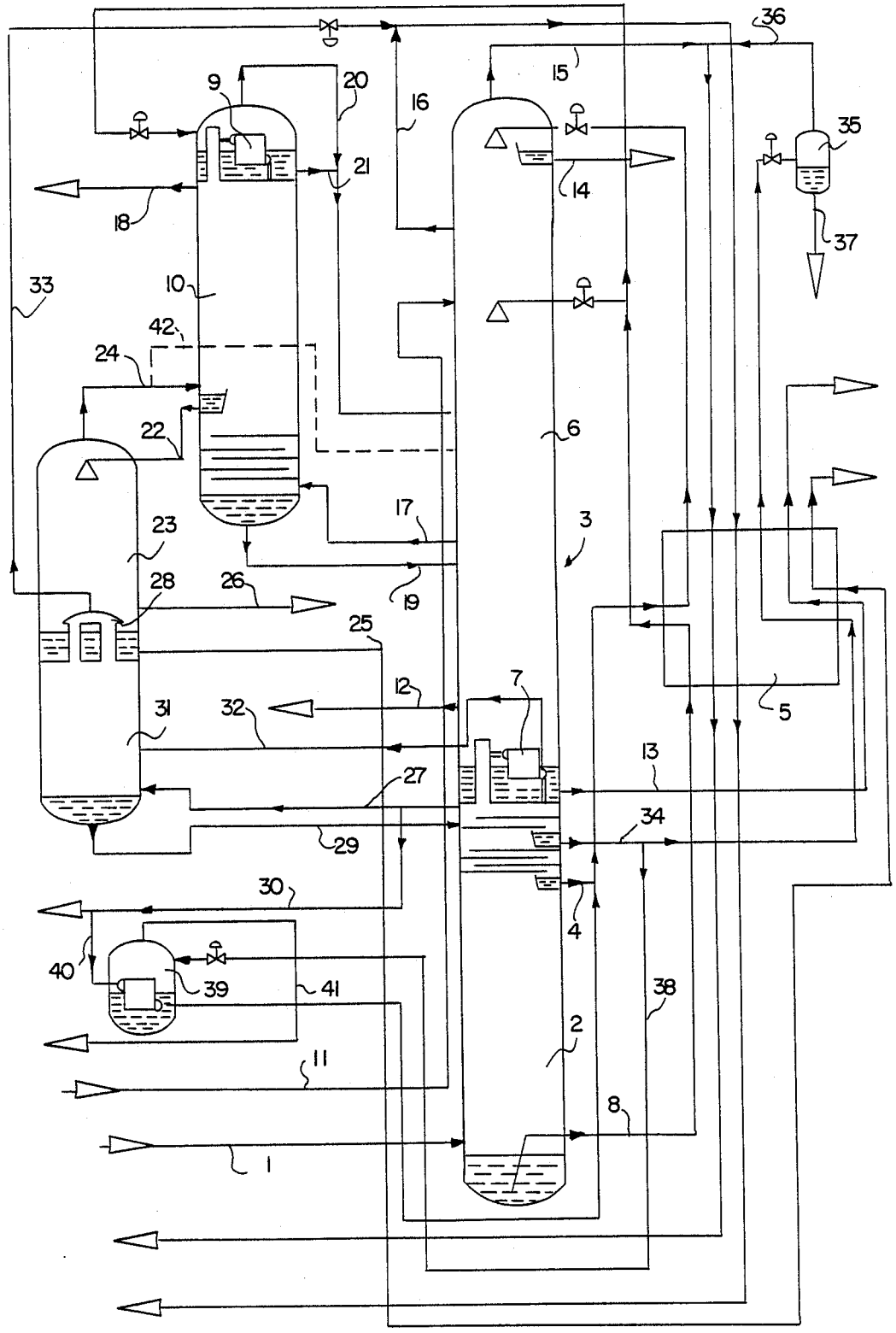
FIG. 4 illustrates another embodiment of the process and apparatus according to the invention for simultaneous production of high-purity oxygen and high-purity nitrogen.

An embodiment of the process according to the invention, in which both high-purity oxygen and high-purity nitrogen can be produced, is represented in FIG. 4. High-purity oxygen column 23 and high-purity nitrogen column 31 are combined in one unit and are in heat exchange connection by a common condenser-evaporator 28. As a result, heating of the bottom high-purity oxygen column 23 and cooling of the head high-purity nitrogen column 31 can be performed with the use of only one heat exchange apparatus.

From the foregoing description, one skilled in the art can easily ascertain the essential characteristics of this invention and, without departing from the spirit and scope thereof, can make various changes and modifications of the invention to adapt it to various usages and conditions.

WHAT IS CLAIMED IS:

1. In a process for air separation by rectification wherein air is preliminarily separated in a first rectification stage of a rectification column into a nitrogen-enriched fraction and an oxygen-enriched fraction, the nitrogen-enriched fraction and oxygen-enriched fraction are fed to a second rectification stage of said rectification column and separated into a further enriched oxygen fraction and a further enriched nitrogen fraction, a stream containing essentially oxygen and argon is removed from the second rectification stage at an intermediate point and is separated by rectification in an argon column into an argon-enriched fraction and a liquid oxygen fraction depleted in argon and the latter liquid fraction is withdrawn from the argon column and fed back into the second rectification stage, the improvement comprising:

(a) removing an additional fraction containing oxygen and argon from said argon column, separating said additional fraction of oxygen and argon in a high-purity oxygen column into a high-purity oxygen fraction and a lighter residual fraction and (b) removing an additional nitrogen-enriched fraction from the head of said first rectification stage and separating said additional nitrogen-enriched fraction in a high-purity nitrogen column into a bottom liquid fraction and a residual gas fraction.

2. A process according to claim 1, wherein the bottom liquid of said high-purity oxygen column is heated by heat exchange with the gas in the head of said high-purity nitrogen column.

3. A process according to claim 2, wherein heat exchange between the bottom of said high-purity oxygen column and the head of said high-purity nitrogen column is provided by a condenser-evaporator common to the two high-purity columns.

4. A process according to claim 1, wherein a high-purity liquid nitrogen fraction is removed from said first rectification stage several plates below the head of said first rectification stage.

5. A process according to claim 4, wherein said high-purity liquid nitrogen fraction removed from the head of said first rectification stage is at least partially subcooled.

6. An apparatus for separating air by rectification comprising:

a first rectification column having a first rectification stage, a second rectification stage, feed means for introducing air to be separated, a first outlet means for removing nitrogen, a second outlet means for removing oxygen, and a third outlet means for removing an argon-enriched fraction, said third outlet means being in fluid communication with said second rectification stage;

an argon column having a first conduit means, a second conduit means and a third conduit means, said first conduit means being in fluid communication with said third outlet means of said first rectification column to provide for delivery of an argon-enriched fraction from said first rectification column to said argon column, said second conduit means being in fluid communication with the bottom of said argon column and with said second rectification stage to provide for delivery of a bottom liquid from sai argon column to said second rectification stage, said third conduit means being positioned in the side of said argon column to provide for lateral removal of a fraction therefrom;

a high-purity oxygen column in fluid communication with said third outlet means of said argon column;

a high-purity nitrogen column, said high-purity nitrogen column being in heat exchange relation when the bottom of said high-purity oxygen column by means of a common condenser-evaporator, said high-purity nitrogen column comprising gas delivery means in fluid communication with said first rectification stage and liquid removal means in fluid communication with said first rectification stage; and a high-purity nitrogen removal pipe attached to said first rectification stage at a point several plates below the head of said first rectification stage.

7. In a process for air separation by rectification wherein air is preliminarily separated in a first rectification stage of a rectification column into a nitrogen-enriched fraction and oxygen-enriched fraction, the nitrogen-enriched fraction and oxygen-enriched fraction are fed to a second rectification stage of said rectification column and separated into a further enriched oxygen fraction and a further enriched nitrogen fraction, a stream containing essentially oxygen and argon is removed from the second rectification stage at an intermediate point and is separated by rectification in an argon column into an argon-enriched fraction and a liquid oxygen fraction depleted in argon and the latter liquid fraction is withdrawn from the argon column and fed back into the second rectification stage, the improvement comprising:

removing an additional fraction containing oxygen and argon from said argon column and separating said additional fraction in a high-purity oxygen column into a high-purity oxygen fraction and a lighter residual fraction.

8. A process according to claim 7, wherein said additional fraction is removed at a point above the point of withdrawal of said liquid oxygen fraction depleted in argon.

9. A process according to claim 7, wherein said additional fraction is removed in liquid form and is fed as reflux liquid into said high-purity oxygen column.

10. A process according to claim 7, wherein said lighter residual fraction is fed back into said argon column.

11. A process according to claim 7, wherein said high-purity oxygen fraction is removed several plates above the bottom of said high-purity oxygen column.

12. A process according to claim 7, wherein liquid oxygen is removed from the bottom of said second rectification stage and subcooled by heat exchange with a nitrogen fraction removed from said second rectification stage.

13. A process according to claim 7, wherein at least part of said high-purity oxygen fraction is removed in gaseous form from said high-purity oxygen column.

14. A process according to claim 7, wherein at least part of the high-purity oxygen fraction is removed in liquid form from said high-purity oxygen column.

15. A process according to claim 7, wherein said high-purity oxygen fraction contains less than about 10 ppm hydrocarbons, 10 ppm krypton, 10 ppm xenon, 10 ppm nitrogen and 20 ppm argon.

16. A process according to claim 7, wherein said high-purity oxygen fraction contains less than about 5 ppm hydrocarbons, 5 ppm krypton, 5 ppm xenon, 5 ppm nitrogen and 15 ppm argon.

17. A process according to claim 7, wherein said argon column contains a plurality of rectification plates and said additional fraction is removed several plates above the bottom of said argon column.

18. A process according to claim 17, wherein said additional fraction is removed from said argon column at a point about 3 to 5 rectification plates above the bottom of said argon column.

19. A process according to claim 7, wherein the bottom of said high-purity oxygen column is heated by nitrogen removed from the head of said first rectification stage.

20. A process according to claim 19, wherein said nitrogen removed from the head of said first rectification stage is at least partially condensed in said high-purity oxygen column and the resultant condensate is fed back into said first rectification stage.

21. A process according to claim 19, wherein a part of said nitrogen removed from the head of said first rectification ttage for heating of the bottom of said high-purity oxygen column is diverted, condensed and added to said nitrogen-enriched fraction removed from said first rectification stage.

22. A process according to claim 21, wherein a high-purity nitrogen fraction is removed in liquid form from the head of said first rectification stage and is at least partly subcooled by heat exchange with a nitrogen fraction removed in gaseous form from the head of said second rectification stage.

23. A process according to claim 22, wherein a part of said high-purity nitrogen fraction removed from the head of said first rectification stage is subcooled by heat exchange with a nitrogen fraction removed from the head of said second rectification stage and throttle-expanded to form a resultant gaseous fraction, said resultant gaseous fraction is then added to said nitrogen fraction removed from the head of said second rectification stage.

24. A process according to claim 22, wherein said high-purity fraction contains at the most about 10 ppm argon.

25. An apparatus for separating air by rectification comprising:

a first rectification column having a first rectification stage, a second rectification stage, feed means for introducing air to be separated, a first outlet means for removing nitrogen, a second outlet means for removing oxygen, and a third outlet means for removing an argon-enriched fraction, said third outlet means being in fluid communication with said second rectification stage;

an argon column having a first conduit means, a second conduit means and a third conduit means, said first conduit means being in fluid communication with said third outlet means of said first rectification column to provide for delivery of an argon-enriched fraction from said first rectification column to said argon column, said second conduit means being in fluid communication with the bottom of said argon column and with said second rectification stage to provide for delivery of a bottom liquid from said argon column to said second rectification stage, said third conduit means being positioned in the side of said argon column to provide for lateral removal of a fraction therefrom; and a high-purity oxygen column in fluid communication with said third outlet means of said argon column.

26. An apparatus according to claim 25, wherein said high-purity oxygen column further comprises a discharge conduit means positioned at the head of said high-purity oxygen column, said discharge conduit means being in fluid communication with said argon column at a point above said third conduit means.

27. An apparatus according to claim 25, wherein said high-purity oxygen column further comprises a discharge conduit means positioned in the head of said high-purity oxygen column, said discharge conduit means being in fluid communication with said second rectification stage at a point above said third outlet means.

28. An apparatus according to claim 25, wherein said argon column contains a plurality of rectification plates and said third conduit means is positioned at a point several rectification plates above the bottom of said argon column.

29. An apparatus according to claim 28, wherein said third conduit means of said argon column is positioned 3 to 5 rectification plates above the bottom of said argon column.

30. In a process for air separation by rectification wherein air is preliminarily separated in a first rectification stage of a rectification column into a nitrogen-enriched fraction and oxygen-enriched fraction, the nitrogen-enriched fraction and oxygen-enriched fraction are fed to a second rectification stage of said rectification column and separated into a further enriched oxygen fraction and a further enriched nitrogen fraction, the improvement comprising:

removing an additional nitrogen-enriched fraction from the head of said first rectification and separating said additional nitrogen-enriched fraction in a high-purity nitrogen column into a bottom liquid fraction and a residual gas fraction.

31. A process according to claim 30, wherein said bottom liquid fraction is fed back to the head of said first rectification stage.

32. A process according to claim 31, wherein a high-purity liquid nitrogen fraction is removed from said first rectification stage several plates below the head of said first rectification stage.

33. A process according to claim 32, wherein said high-purity liquid nitrogen fraction is at least partially evaporated by heat exchange with a condensing nitrogen stream removed from the head of said first rectification stage.

34. A process according to claim 32, wherein said high-purity liquid nitrogen fraction removed from the head of said first rectification stage is at least partially subcooled.

35. A process according to claim 34, wherein said high-purity liquid nitrogen fraction is at least partially evaporated by heat exchange with a condensing nitrogen stream removed from the head of said first rectification stage.

* * * * *

UNITED STATES PATENT AND TRADEMARK OFFICE

CERTIFICATE OF CORRECTION

PATENT NO. : 4,824,453

DATED : April 25, 1989

INVENTOR(S) : Rottmann et al

It is certified that error appears in the above-identified patent and that said Letters Patent is hereby corrected as shown below:

Column 10, Line 51, claim 6:

reads: "tom liquid from sai argon column to said second"

should read: --tom liquid from said argon column to said second--

Signed and Sealed this

Ninth Day of January, 1990

*Attest:*

JEFFREY M. SAMUELS

*Attesting Officer*

*Acting Commissioner of Patents and Trademarks*